US011635719B2

(12) United States Patent
Kakigahara et al.

(10) Patent No.: US 11,635,719 B2
(45) Date of Patent: Apr. 25, 2023

(54) FIXING DEVICE

(71) Applicant: BROTHER KOGYO KABUSHIKI KAISHA, Nagoya (JP)

(72) Inventors: Yutaka Kakigahara, Nagoya (JP); Masamitsu Takahashi, Nagoya (JP); Satoshi Murata, Nagoya (JP); Kengo Takeda, Tokai (JP); Masataka Kamiya, Owariasahi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/487,267

(22) Filed: Sep. 28, 2021

(65) Prior Publication Data

US 2022/0011700 A1 Jan. 13, 2022

Related U.S. Application Data

(63) Continuation of application No. PCT/JP2019/051138, filed on Dec. 26, 2019.

(30) Foreign Application Priority Data

Mar. 28, 2019 (JP) ..... JP2019-063821
Dec. 4, 2019 (JP) ..... JP2019-219836

(51) Int. Cl.
*G03G 15/20* (2006.01)

(52) U.S. Cl.
CPC ..... *G03G 15/2096* (2013.01); *G03G 15/20* (2013.01)

(58) Field of Classification Search
CPC ..... G03G 15/0865; G03G 15/0872; G03G 15/0879; G03G 15/0886; G03G 2215/0132; G03G 20/2096
See application file for complete search history.

(56) References Cited

U.S. PATENT DOCUMENTS

2011/0103837 A1 5/2011 Toyoda et al.
2013/0287962 A1 10/2013 Deng et al.
(Continued)

FOREIGN PATENT DOCUMENTS

EP 3 358 424 A1 8/2018
JP S47-049617 B1 12/1972
(Continued)

OTHER PUBLICATIONS

International Preliminary Report on Patentability and translation of Written Opinion dated Sep. 28, 2021 received in International Application No. PCT/JP2019/051138.
(Continued)

*Primary Examiner* — Jessica L Eley
(74) *Attorney, Agent, or Firm* — Scully, Scott, Murphy & Presser, PC

(57) ABSTRACT

A fixing device 9 has a nozzle unit 9A. The nozzle unit 9A sprays the fixing solution to a sheet S on which a toner image is formed. The nozzle unit 9A has a housing 21, a nozzle electrode 23 and a plurality of nozzles 22. The plurality of nozzles 22 has a first nozzle 22A and a second nozzle 22B located at an interval from the first nozzle 22A in a first direction, and the nozzle electrode 23 is located inside the housing 21. The nozzle electrode 23 extends in the first direction. A length L1 of the nozzle electrode 23 in the first direction is greater than the interval between the first nozzle 22A and the second nozzle 22B in the first direction.

18 Claims, 13 Drawing Sheets

(56) References Cited

U.S. PATENT DOCUMENTS

| | | | | |
|---|---|---|---|---|
| 2017/0364003 | A1* | 12/2017 | Takagi | G03G 15/2057 |
| 2018/0217543 | A1* | 8/2018 | Kakigahara | G03G 15/2096 |

FOREIGN PATENT DOCUMENTS

| | | | | |
|---|---|---|---|---|
| JP | S62-087975 | A | 4/1987 | |
| JP | 2001-138503 | A | 5/2001 | |
| JP | 2008-517742 | A | 5/2008 | |
| JP | 2010-032858 | A | 2/2010 | |
| JP | 2012-083505 | A | 4/2012 | |
| JP | 2017-068098 | A | 4/2017 | |
| JP | 2017-122805 | A | 7/2017 | |
| JP | 2017167245 | A * | 9/2017 | G03G 15/20 |
| WO | 2006/044877 | A2 | 4/2006 | |
| WO | 2017/057684 | A1 | 4/2017 | |

OTHER PUBLICATIONS

International Search Report dated Feb. 10, 2020 received in International Application No. PCT/JP2019/051138 together with an English langauge translation.

Extended European Search Report dated Sep. 9, 2022 from related EP 19922022.9.

* cited by examiner

FIXING DEVICE

CROSS-REFERENCE TO RELATED APPLICATION

This is a continuation application of International Application No. PCT/JP2019/051138 filed on Dec. 26, 2019 which claims the benefit of priority from Japanese patent applications No. 2019-063821 filed on Mar. 28, 2019 and No. 2019-219836 filed on Dec. 4, 2019. The entire contents of the earlier applications are incorporated herein by reference.

TECHNICAL FIELD

The present invention relates to a fixing device.

BACKGROUND

In the related art, a fixing device has a nozzle unit. The nozzle unit sprays a fixing solution onto a sheet on which a toner image is formed. The nozzle unit has a housing, a nozzle electrode, and a plurality of nozzles including a first nozzle and a second nozzle (refer to JP-A-2017-068098).

In JP-A-2017-068098, a distance from the nozzle electrode to the first nozzle and a distance from the nozzle electrode to the second nozzle are different.

For this reason, an amount of the fixing solution sprayed from the first nozzle and an amount of the fixing solution sprayed from the second nozzle may be different.

SUMMARY

It is therefore an object of the present disclosure to provide a fixing device capable of suppressing an excessive difference between an amount of a fixing solution sprayed from a first nozzle and an amount of a fixing solution sprayed from a second nozzle.

(1) A fixing device of the present disclosure fixes a toner image on a sheet. The fixing device includes a nozzle unit.

The nozzle unit sprays a fixing solution onto the sheet on which the toner image is formed. The nozzle unit has a housing, a nozzle electrode and a plurality of nozzles.

The housing can accommodate the fixing solution.

The nozzle electrode is located in the housing. The nozzle electrode extends in a first direction.

The plurality of nozzles discharge the fixing solution electrically charged by the nozzle electrode from the housing. The plurality of nozzles are aligned in the first direction. The plurality of nozzles includes a first nozzle and a second nozzle. The second nozzle is located at an interval from the first nozzle in the first direction.

A length of the nozzle electrode in the first direction is greater than the interval between the first nozzle and the second nozzle in the first direction.

According to the configuration, the nozzle electrode extends in the first direction. The length of the nozzle electrode in the first direction is greater than the interval between the first nozzle and the second nozzle in the first direction.

Thereby, a distance from the nozzle electrode to a tip end of the first nozzle in a second direction and a distance from the nozzle electrode to a tip end of the second nozzle in the second direction become uniform.

Therefore, it is possible to suppress an excessive difference in electric charge amount of the fixing solution between the tip end of the first nozzle and the tip end of the second nozzle.

As a result, it is possible to suppress an excessive difference between an amount of the fixing solution sprayed from the first nozzle and an amount of the fixing solution sprayed from the second nozzle.

(2) The fixing device may further include an opposite electrode. The opposite electrode is located at an interval from the nozzle unit in a second direction intersecting with the first direction. The opposite electrode is applied with a voltage.

(3) The first direction may intersect with a third direction in which the sheet is conveyed. The second direction may intersect with the third direction.

(4) The first nozzle may be located at one end of the plurality of nozzles in the first direction. The second nozzle may be located at the other end of the plurality of nozzles in the first direction.

(5) The housing may have an inlet. The fixing solution that enters the housing passes through the inlet. The nozzle electrode may be located between the plurality of nozzles and the inlet in the second direction.

According to the configuration, it is possible to bring the fixing solution entering the housing from the inlet into contact with the nozzle electrode before the fixing solution reaches the plurality of nozzles.

(6) The nozzle electrode may be located closer to the plurality of nozzles than the inlet in the second direction.

(7) The plurality of nozzles may be located on an outer surface of the housing. The nozzle electrode may be located on an inner surface of the housing.

(8) The nozzle electrode may be in contact with the inner surface of the housing.

(9) The housing may have a first hole and a second hole. The first hole allows the fixing solution to enter the first nozzle. The second hole allows the fixing solution to enter the second nozzle. The nozzle electrode may have a first notch and a second notch. The first notch allows the fixing solution to enter the first hole. The second hole allows the fixing solution to enter the second hole.

(10) A diameter of the first notch may be smaller than a diameter of the first hole. A diameter of the second notch may be smaller than a diameter of the second hole.

(11) The nozzle unit may further include a supply electrode. The supply electrode supplies electric power to the nozzle electrode. The supply electrode is supported by the housing. The supply electrode may be electrically connected to the nozzle electrode.

(12) The supply electrode may have a projection. The nozzle electrode may have a hole. The projection is fitted in the hole.

According to the configuration, with the simple configuration where the projection of the supply electrode is fitted in the hole of the nozzle electrode, it is possible to decide a position of the nozzle electrode with respect to the housing via the supply electrode.

(13) The nozzle electrode may be attached to the inner surface of the housing by heat caulking.

(14) The nozzle electrode may be made of metal.

According to the fixing device of the present disclosure, it is possible to suppress the excessive difference between the amount of the fixing solution sprayed from the first nozzle and the amount of the fixing solution sprayed from the second nozzle.

DETAILED DESCRIPTION

1. Outline of Image Forming Apparatus

Figure 1:
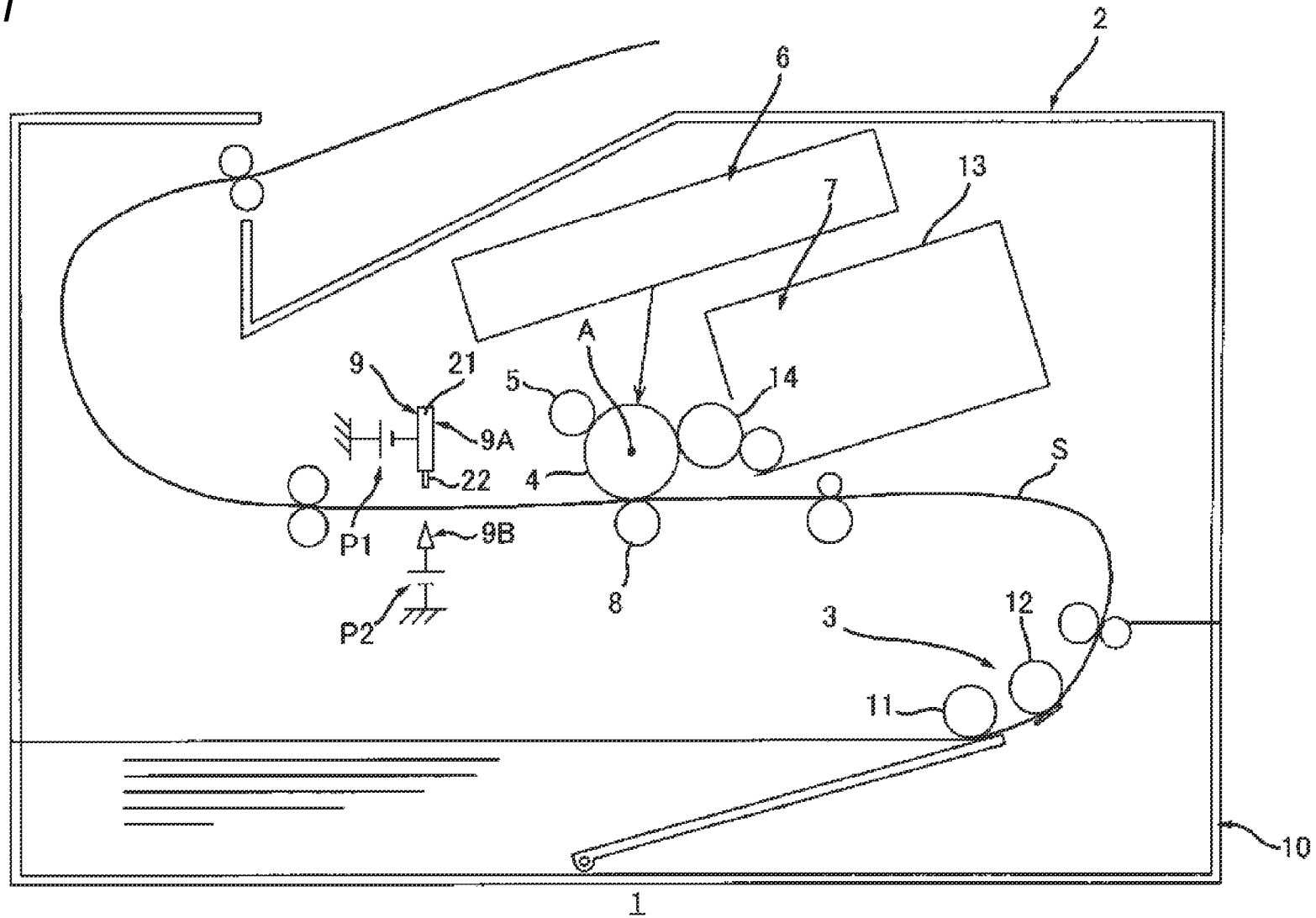
FIG. 1 is a schematic configuration view of an image forming apparatus.

An outline of an image forming apparatus is described with reference to FIG. 1.

An image forming apparatus 1 includes a main body housing 2, a sheet feeding unit 3, a photosensitive drum 4, a charging device 5, an exposure device 6, a developing device 7, a transfer device 8, and a fixing device 9.

1.1 Housing

The main body housing 2 accommodates the sheet feeding unit 3, the photosensitive drum 4, the charging device 5, the exposure device 6, the developing device 7, the transfer device 8, and the fixing device 9.

1.2 Sheet Feeding Unit

The sheet feeding unit 3 feeds a sheet S to the photosensitive drum 4. The sheet feeding unit 3 includes a sheet cassette 10, a pickup roller 11, and a conveying roller 12. The sheet cassette 10 accommodates sheets S. The sheet S is, for example, a printing sheet. The pickup roller 11 conveys the sheet S in the sheet cassette 10 toward the conveying roller 12. The conveying roller 12 conveys the sheet S from the pickup roller 11 toward the photosensitive drum 4.

1.3 Photosensitive Drum

The photosensitive drum 4 can rotate about an axis A. The axis A extends in a first direction. The photosensitive drum 4 has a cylindrical shape. The photosensitive drum 4 extends along the axis A.

1.4 Charging Device

The charging device 5 electrically charges a surface of the photosensitive drum 4. The charging device 5 is, specifically, a charging roller. Note that, the charging device 5 may also be a scorotron-type charger. In a case where the charging device 5 is a charging roller, the charging device 5 is in contact with the surface of the photosensitive drum 4. In a case where the charging device 5 is a scorotron-type charging device, the charging device 5 is located at an interval from the surface of the photosensitive drum 4.

1.5 Exposure Device

The exposure device 6 exposes the surface of the photosensitive drum 4. Specifically, the exposure device 6 exposes the surface of the photosensitive drum 4 electrically charged by the charging device 5. Thereby, an electrostatic latent image is formed on the surface of the photosensitive drum 4. The exposure device 6 is, specifically, a laser scan unit. Note that, the exposure device 6 may also be an LED array.

1.6 Developing Device

The developing device 7 supplies toner to the surface of the photosensitive drum 4. Thereby, the electrostatic latent image is developed, so that a toner image is formed on the surface of the photosensitive drum 4. The developing device 7 includes a toner accommodation unit 13 and a developing roller 14.

The toner accommodation unit 13 accommodates toner. Toner contains toner particles, and as required, an external additive. The toner particles contain a binding resin, and as required, a colorant, a pigment dispersant, a mold release agent, a magnetic material and a charge control agent. The binding resin is a base of the toner particles. The binding resin binds the components contained in the toner particles. The colorant imparts a desired color to the toner particles. The colorant is dispersed in the binding resin. The pigment dispersant improves dispersibility of the colorant. The charge control agent gives chargeability to the toner particles. The chargeability may be any of positive chargeability and negative chargeability. The external additive regulates chargeability, flowability and storage stability of the toner particles.

The developing roller 14 supplies toner in the toner accommodation unit 13 to the surface of the photosensitive drum 4. The developing roller 14 is in contact with the photosensitive drum 4. Note that, the developing roller 14 may not be in contact with the photosensitive drum 4.

The developing device 7 may be constituted as one process unit, together with the photosensitive drum 4 and the charging device 5. The process unit can be mounted to the main body housing 2.

In addition, the developing device 7 may be a developing cartridge that can be mounted to a drum unit having the photosensitive drum 4 and the charging device 5. The drum unit can be mounted to the main body housing 2.

The developing device 7 may also have a developing unit having the developing roller 14, and a toner cartridge that can be mounted to the developing unit. In this case, the toner cartridge has the toner accommodation unit 13. In addition, the developing unit may be provided to the drum unit. The developing unit can be mounted to the drum unit.

1.7 Transfer Device

The transfer device 8 transfers the toner image from the photosensitive drum 4 to the sheet S. Thereby, the toner image is formed on the sheet S. The transfer device 8 is in contact with the photosensitive drum 4. Note that, the transfer device 8 may not be in contact with the photosensitive drum 4. The transfer device 8 is, specifically, a transfer roller. Note that, the transfer device 8 may also be a transfer belt.

1.8 Fixing Device

The fixing device 9 provides a fixing solution to the toner image to fix the toner image on the sheet S. Specifically, the fixing device 9 sprays the ionized fixing solution toward the toner image on the sheet S by electrostatic spraying, thereby providing the fixing solution to the toner image. Then, the toner is softened by the fixing solution and then cured, so that it is fixed on the sheet S. The sheet S on which the toner image is fixed is discharged outside the main body housing 2.

2. Details of Fixing Device

Subsequently, details of the fixing device 9 are described with reference to FIGS. 1 to 5B.

As shown in FIG. 1, the fixing device 9 includes a nozzle unit 9A and an opposite electrode 9B.

2.1 Nozzle Unit

Figure 2:
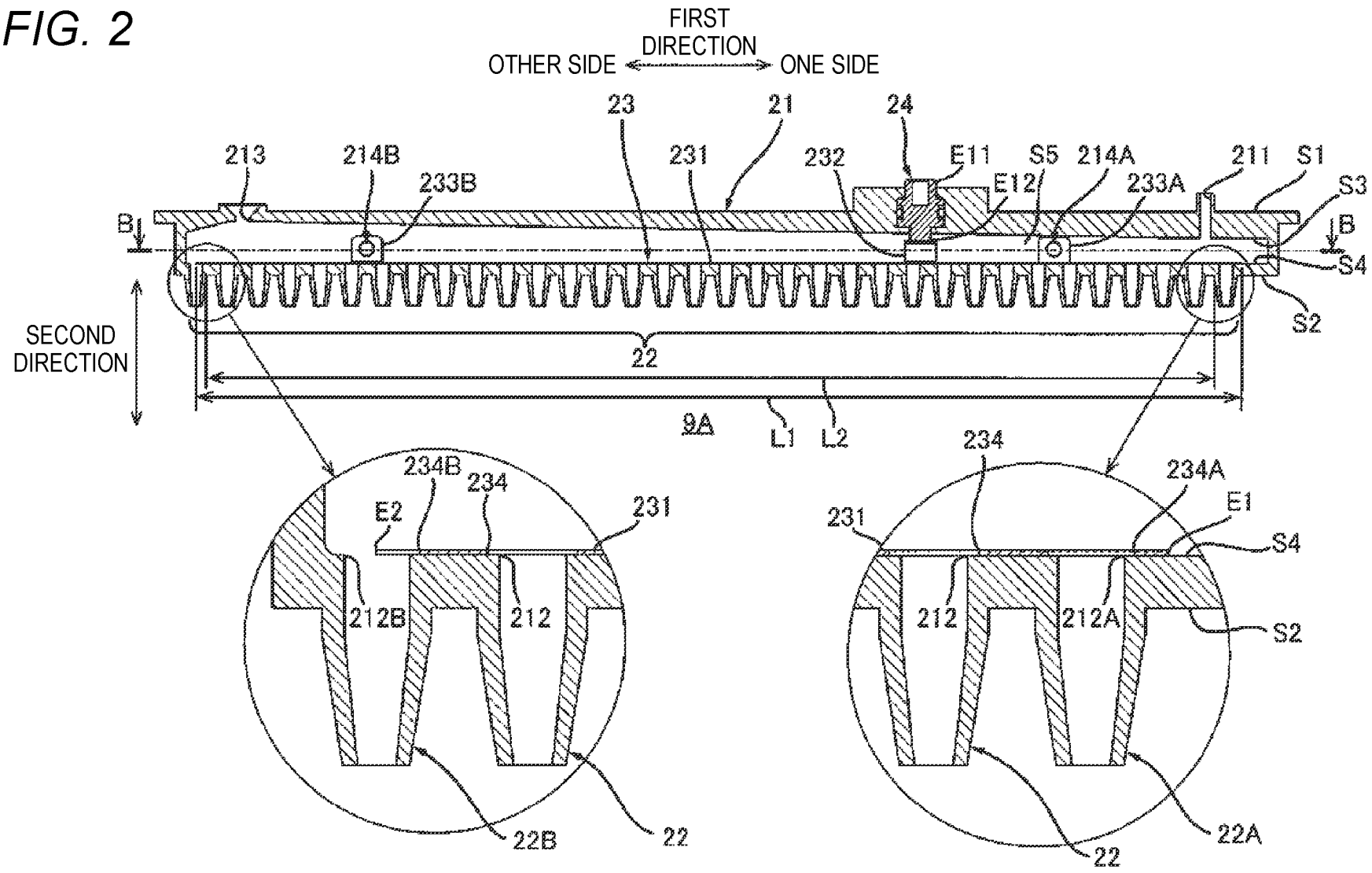
FIG. 2 is a cross-sectional view of a nozzle unit shown in FIG. 1, which is taken along a line A-A of FIG. 4.

The nozzle unit 9A sprays the fixing solution to the sheet S on which the toner image is formed. As shown in FIG. 2, the nozzle unit 9A includes a housing 21, a plurality of nozzles 22, a nozzle electrode 23 and a supply electrode 24.

2.1.1 Housing

The housing 21 can accommodate the fixing solution. The housing 21 extends in the first direction. The first direction is a direction in which the axis A of the photosensitive drum 4 extends. The first direction is also a width direction of the sheet S. The housing 21 has an outer surface S1 and an outer surface S2 in a second direction. The second direction is a direction facing from the nozzle unit 9A toward the opposite electrode 9B (refer to FIG. 1). The second direction intersects with the first direction. Specifically, the second direction is orthogonal to the first direction. The outer surface S2 is located distant from the outer surface S1 in the second direction. The outer surface S2 is located closer to the opposite electrode 9B than the outer surface S1 in the second direction. The housing 21 has an inner surface S3 and an inner surface S4 in the second direction. The inner surface S4 is located distant from the inner surface S3 in the second direction. The inner surface S4 is located closer to the plurality of nozzles 22 than the inner surface S3 in the second direction. In other words, the inner surface S4 is located between the inner surface S3 and the plurality of nozzles 22 in the second direction. The housing 21 also has an inlet 211, a plurality of holes 212, an exhaust port 213, and two bosses 214A and 214B.

2.1.1.1 Inlet

The inlet 211 is located on the outer surface S1 of the housing 21. The inlet 211 is located at one end portion of the housing 21 in the first direction. The inlet 211 is formed to communicate with an internal space of the housing 21. The fixing solution that enters the housing 21 passes through the inlet 211. Specifically, the image forming apparatus 1 includes a tank (not shown), a pipe (not shown), and a pump (not shown). The tank can accommodate a larger amount of fixing solution than the housing 21. The pipe connects the tank and the housing 21 each other. The pump pumps the fixing solution from the tank to the housing 21. The fixing solution in the tank is pumped to the inlet 211 of the housing 21 through the pipe by the pump. The pumped fixing solution passes through the inlet 211 and enters the housing 21.

2.1.1.2 Hole

Figure 3:
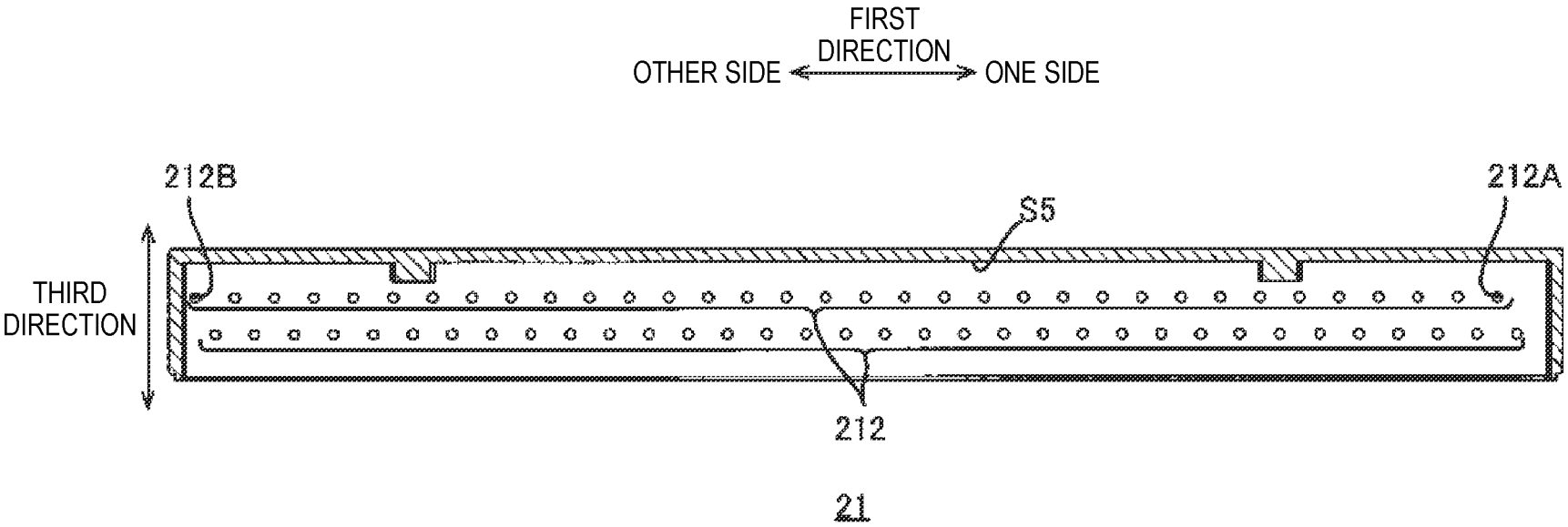
FIG. 3 is a cross-sectional view of a housing shown in FIG. 2, which is taken along a line B-B of FIG. 2.

As shown in FIG. 3, the plurality of holes 212 is located on the inner surface S4 of the housing 21. The plurality of holes 212 is aligned at intervals in the first direction. Specifically, the plurality of holes 212 is arranged in a zigzag form. The plurality of holes 212 includes a first hole 212A and a second hole 212B.

The first hole 212A is located at one end of the plurality of holes 212 in the first direction. The first hole 212A is formed to communicate with an internal space of the first nozzle 22A (refer to FIG. 2). Thereby, the first hole 212A allows the fixing solution to enter the first nozzle 22A.

The second hole 212B is located at the other end of the plurality of holes 212 in the first direction. The second hole 212B is formed to communicate with an internal space of the second nozzle 22B (refer to FIG. 2). Thereby, the second hole 212B allows the fixing solution to enter the second nozzle 22B.

2.1.1.3 Exhaust Port

As shown in FIG. 2, the exhaust port 213 is located on the outer surface S1 of the housing 21. The exhaust port 213 is located at an interval from the inlet 211 in the first direction. The exhaust port 213 is located at the other end portion of the housing 21 in the first direction. The exhaust port 213 is formed to communicate with the internal space of the housing 21. The exhaust port 213 exhausts air in the housing 21 at a time when the fixing solution enters the housing 21.

2.1.1.4 Boss

As shown in FIG. 2, the boss 214A is located inside the housing 21. The boss 214A is located between the inlet 211 and the supply electrode 24 in the first direction. The boss 214A extends in a third direction. The third direction is a direction in which the sheet S is conveyed. The third direction intersects with both the first direction and the second direction. The boss 214A extends from the inner surface of the housing 21 in the third direction. The boss 214A is made of a thermoplastic resin.

The boss 214B is located inside the housing 21. The boss 214B is located at an interval from the boss 214A in the first direction. The boss 214B is located between the exhaust port 213 and the supply electrode 24 in the first direction. The boss 214B extends in the third direction. The boss 214B extends from the inner surface of the housing 21 in the third direction. The boss 214B is made of a thermoplastic resin.

2.1.2 Nozzle

As shown in FIG. 2, the plurality of nozzles 22 is located on the outer surface S2 of the housing 21. The plurality of nozzles 22 is located between the nozzle electrode 23 and the opposite electrode 9B (refer to FIG. 1) in the second direction. Each of the plurality of nozzles 22 extends from the outer surface S2 of the housing 21 in the second direction. The plurality of nozzles 22 is aligned at intervals in the first direction. Specifically, the plurality of nozzles 22 is arranged in a zigzag form. The plurality of nozzles 22 includes a first nozzle 22A and a second nozzle 22B. In other words, the nozzle unit 9A includes the first nozzle 22A and the second nozzle 22B. The first nozzle 22A and the second nozzle 22B are located on the outer surface S2 of the housing 21.

The first nozzle 22A is located at one end of the plurality of nozzles 22 in the first direction. The first nozzle 22A discharges the fixing solution entering the first nozzle 22A through the first hole 212A.

The second nozzle 22B is located at an interval from the first nozzle 22A in the first direction. The second nozzle 22B is located at the other end of the plurality of nozzles 22 in the first direction. The second nozzle 22B discharges the fixing solution entering the second nozzle 22B through the second hole 212B.

2.1.3 Nozzle Electrode

Figure 4:
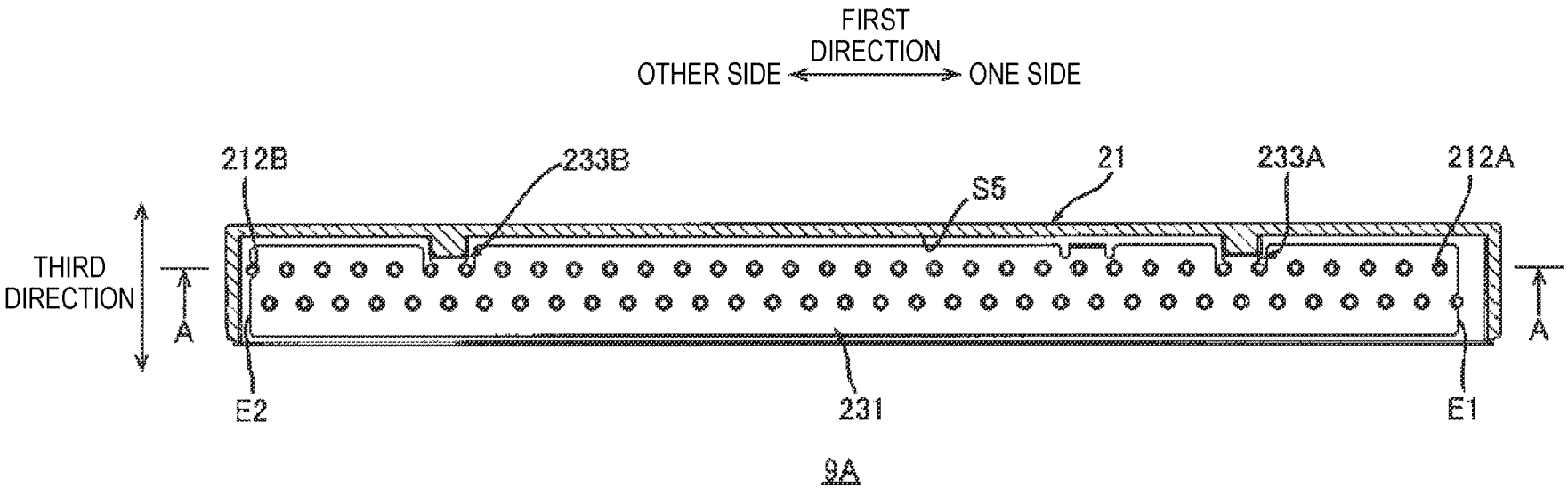
FIG. 4 is a cross-sectional view of the nozzle unit shown in FIG. 2, which is taken along the line B-B of FIG. 2.
Figure 5A:
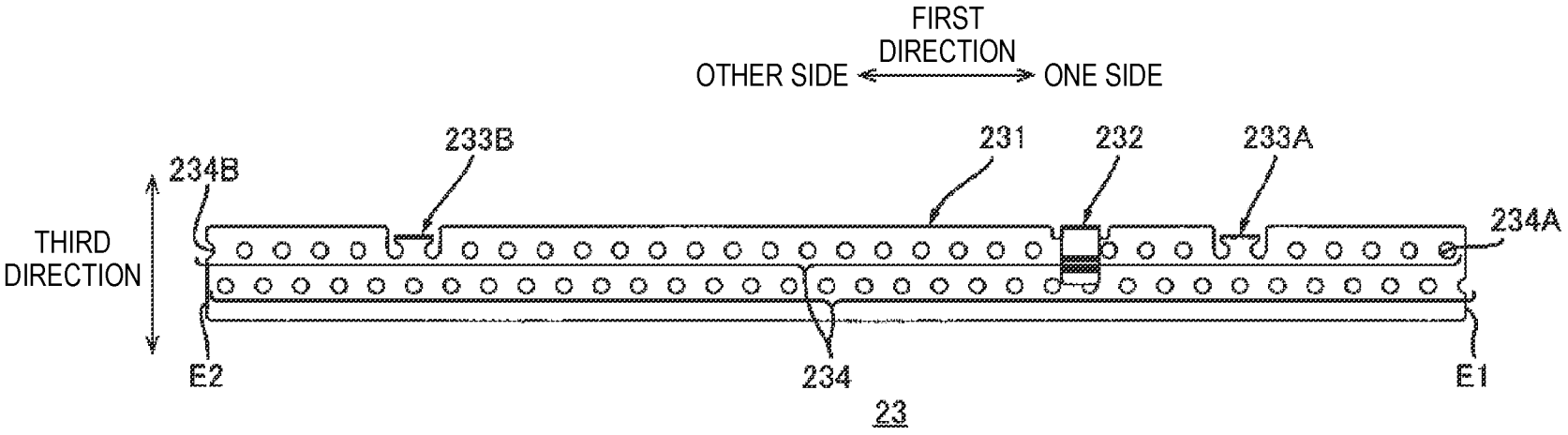
FIG. 5A is a plan view of a nozzle electrode shown in FIG. 4.
Figure 5B:
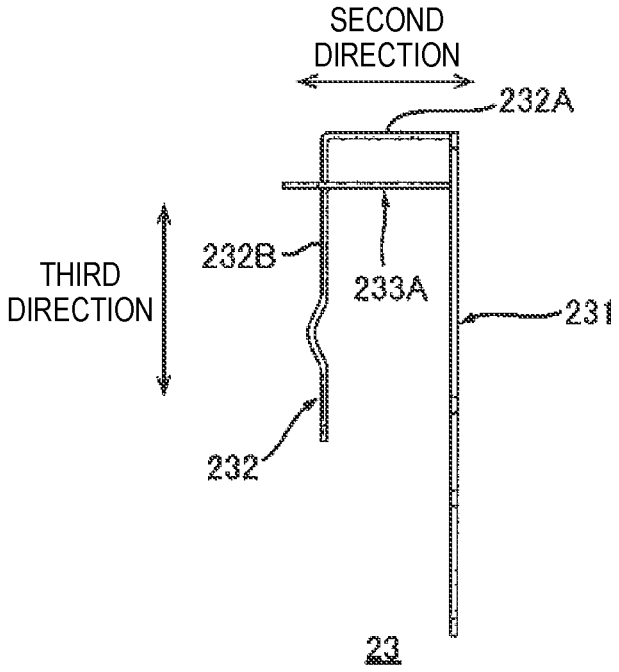
FIG. 5B is a side view of the nozzle electrode shown in FIG. 4.

As shown in FIGS. 2 and 4, the nozzle electrode 23 is located inside the housing 21. The nozzle electrode 23 extends in the first direction. The nozzle electrode 23 is made of metal. As shown in FIGS. 5A and 5B, the nozzle electrode 23 has a body portion 231, a contact portion 232, and two fixing portions 232A and 232B.

2.1.3.1 Body Portion

As shown in FIG. 2, the body portion 231 is located between the plurality of nozzles 22 and the inlet 211 in the second direction. Specifically, the nozzle electrode 23 is located between the first nozzle 22A and the inlet 211 in the second direction. Thereby, the fixing solution entering the housing 21 from the inlet 211 contacts the body portion 231 before reaching the plurality of nozzles 22. The fixing solution contacting the body portion 231 is electrically charged by the voltage applied to the nozzle electrode 23.

More specifically, the body portion 231 is located closer to the first nozzle 22A than the inlet 211. The body portion 231 is located on the inner surface S4 of the housing 21. The body portion 231 is in contact with the inner surface S4 of the housing 21.

As shown in FIGS. 2 and 4, the body portion 231 extends in the first direction. The body portion 231 extends from the first hole 212A to the second hole 212B in the first direction. In other words, the body portion 231 extends from the first nozzle 22A to the second nozzle 22B in the first direction. A length L1 of the body portion 231 of the nozzle electrode 23 in the first direction is greater than an interval L2 between the first nozzle 22A and the second nozzle 22B in the first direction. Thereby, distances from the nozzle electrode 23 to tip ends of each of the plurality of nozzles 22 in the second direction become uniform. For this reason, electric charge amounts of the fixing solution at the tip ends of each of the plurality of nozzles 22 become uniform.

Specifically, the body portion 231 has a first end portion E1 and a second end portion E2 in the first direction. The second end portion E2 is located distant from the first end portion E1 in the first direction. The first end portion E1 of the body portion 231 is located on an opposite side to the opposite electrode 9B (refer to FIG. 1) with respect to the first nozzle 22A in the second direction. The second end portion E2 of the body portion 231 is located on an opposite side to the opposite electrode 9B with respect to the second nozzle 22B in the second direction. The body portion 231 has a flat plate shape. As shown in FIG. 5A, the body portion 231 has a plurality of notches 234.

The plurality of notches 234 is aligned at intervals in the first direction. The plurality of notches 234 is arranged in a zigzag form. The plurality of notches 234 includes a first notch 234A and a second notch 234B. In other words, the nozzle electrode 23 has the first notch 234A and the second notch 234B.

The first notch 234A is located at one end of the plurality of notches 234 in the first direction. The first notch 234A has a circular shape. A diameter of the first notch 234A is greater than a diameter of the first hole 212A (refer to FIG. 3). As shown in FIG. 2, the first notch 234A is formed to communicate with the first hole 212A. Thereby, the fixing solution contacting the body portion 231 and electrically charged enters the first hole 212A through the first notch 234A. That is, the first notch 234A allows the fixing solution to enter the first hole 212A. The fixing solution entering the first hole 212A is discharged from the first nozzle 22A. Specifically, the first nozzle 22A discharges the fixing solution electrically charged by the nozzle electrode 23 from the housing 21. At this time, the fixing solution passing through the tip end of the first nozzle 22A is misted by an electrostatic force between the nozzle electrode 23 and the opposite electrode 9B (refer to FIG. 1). The misted fixing solution is provided to the sheet S (refer to FIG. 1) passing between the nozzle unit 9A and the opposite electrode 9B.

The second notch 234B is located at the other end of the plurality of notches 234 in the first direction. The second notch 234B has a semicircular shape. A diameter of the second notch 234B is greater than a diameter of the second hole 212B (refer to FIG. 3). As shown in FIG. 2, the second notch 234B is formed to communicate with the second hole 212B. Thereby, the fixing solution contacting the body portion 231 and electrically charged enters the second hole 212B through the second notch 234B. That is, the second notch 234B allows the fixing solution to enter the second hole 212B. The fixing solution entering the second hole 212B is discharged from the second nozzle 22B. Specifically, the second nozzle 22B discharges the fixing solution electrically charged by the nozzle electrode 23 from the housing 21. At this time, the fixing solution passing through the tip end of the second nozzle 22B is also misted by the electrostatic force between the nozzle electrode 23 and the opposite electrode 9B and is provided to the sheet S passing between the nozzle unit 9A and the opposite electrode 9B, similar to the fixing solution passing through the tip end of the first nozzle 22A.

2.1.3.2 Contact Portion

As shown in FIG. 2, the contact portion 232 is in contact with the supply electrode 24. Thereby, the nozzle electrode 23 can receive electric power from the supply electrode 24. As shown in FIG. 5A, the contact portion 232 is located between the first end portion E1 and the second end portion E2 of the body portion 231 in the first direction. As shown in FIG. 5B, the contact portion 232 extends from the body portion 231. Specifically, the contact portion 231 has a bent plate shape. The contact portion 232 has a first portion 232A and a second portion 232B.

The first portion 232A extends from the body portion 231 in the second direction.

The second portion 232B extends from the first portion 232A in the third direction. The second portion 232B is located at an interval from the body portion 231 in the second direction.

2.1.3.3 Fixing Portion

As shown in FIG. 4, the fixing portion 233A is fixed to an inner surface S5 of the housing 21 in the third direction. The inner surface S5 is located between the inner surface S3 and the inner surface S4 in the second direction. The inner surface S5 extends in the second direction. Specifically, as shown in FIG. 5A, the fixing portion 233A is located between the first end portion E1 of the body portion 231 and the contact portion 232 in the first direction. As shown in FIG. 5B, the fixing portion 233A extends from the body portion 231 in the second direction. The fixing portion 233A has a flat plate shape. The fixing portion 233A has a through-hole. The boss 214A (refer to FIG. 2) of the housing 21 passes through the through-hole. In a state where the boss 214A passes through the through-hole of the fixing portion 233A, the boss 214A is deformed by heat caulking, so that the fixing portion 233A is fixed to the inner surface of the housing 21 in the third direction.

As shown in FIG. 4, the fixing portion 233B is fixed to the inner surface of the housing 21 in the third direction by heat caulking, similar to the fixing portion 233A. Specifically, as shown in FIG. 5A, the fixing portion 233B is located between the second end portion E2 of the body portion 231 and the contact portion 232 in the first direction. As shown in FIG. 5B, the fixing portion 233B extends from the body portion 231 in the second direction. The fixing portion 233B has a flat plate shape, similar to the fixing portion 233A. The fixing portion 233B has a through-hole. The boss 214B (refer to FIG. 2) of the housing 21 passes through the through-hole.

As shown in FIG. 4, the fixing portion 233A and the fixing portion 233B are fixed to the inner surface of the housing 21 in the third direction by heat caulking, so that the nozzle electrode 23 is attached to the inner surface of the housing 21 in the third direction. Specifically, the nozzle electrode 23 is attached to the inner surface of the housing 21 in the third direction by heat caulking.

2.1.4 Supply Electrode

As shown in FIG. 2, the supply electrode 24 is supported by the housing 21. The supply electrode 24 is made of metal. The supply electrode 24 extends in the second direction. The supply electrode 24 has a first end portion E11 and a second end portion E12 in the second direction. The first end portion E11 is located on the outer surface of the housing 21. The second end portion E12 is located distant from the first end portion E11 in the second direction. The second end portion E12 is located inside the housing 21. The second end portion E12 is in contact with the contact portion 232 of the nozzle electrode 23. Thereby, the supply electrode 24 is electrically connected to the nozzle electrode 23. In addition, the supply electrode 24 is electrically connected to a power supply P1 (refer to FIG. 1) provided in the image forming apparatus 1, at the first end portion E11. Thereby, the supply electrode 24 supplies electric power from the power supply P1 to the nozzle electrode 23.

2.2, Opposite Electrode

As shown in FIG. 1, the opposite electrode 9B is located at an interval from the nozzle unit 9A in the second direction. The opposite electrode 9B extends in the first direction. The opposite electrode 9B is electrically connected to a power supply P2 provided in the image forming apparatus 1. Thereby, the opposite electrode 9B is applied with a voltage.

3. Operational Effects

As shown in FIGS. 2 and 4, according to the fixing device 9, the body portion 231 of the nozzle electrode 23 extends in the first direction. A length L1 of the body portion 231 of the nozzle electrode 23 in the first direction is greater than an interval L2 between the first nozzle 22A and the second nozzle 22B in the first direction.

Thereby, a distance from the nozzle electrode 23 to a tip end of the first nozzle 22A in the second direction and a distance from the nozzle electrode 23 to a tip end of the second nozzle 22B in the second direction become uniform.

Therefore, it is possible to suppress an excessive difference in electric charge amount of the fixing solution between the tip end of the first nozzle 22A and the tip end of the second nozzle 22B.

As a result, it is possible to suppress an excessive difference between an amount of the fixing solution sprayed from the first nozzle 22A and an amount of the fixing solution sprayed from the second nozzle 22B.

In addition, as shown in FIG. 2, according to the fixing device 9, the nozzle electrode 23 is located between the plurality of nozzles 22 and the inlet 211 in the second direction.

Thereby, the fixing solution entering the housing 21 from the inlet 211 can be contacted to the body portion 231 before the fixing solution reaches the plurality of nozzles 22.

4. Modified Examples

Modified examples are described with reference to FIGS. 6 to 11. Note that, in the modified examples, the same members as the above embodiment are denoted with the same reference signs, and the descriptions thereof are omitted.

(1) The notch 234 of the nozzle electrode 23 is not limited in terms of a size and a shape as long as the notch 234 can allow the fixing solution to enter the nozzle 22.

Figure 6:
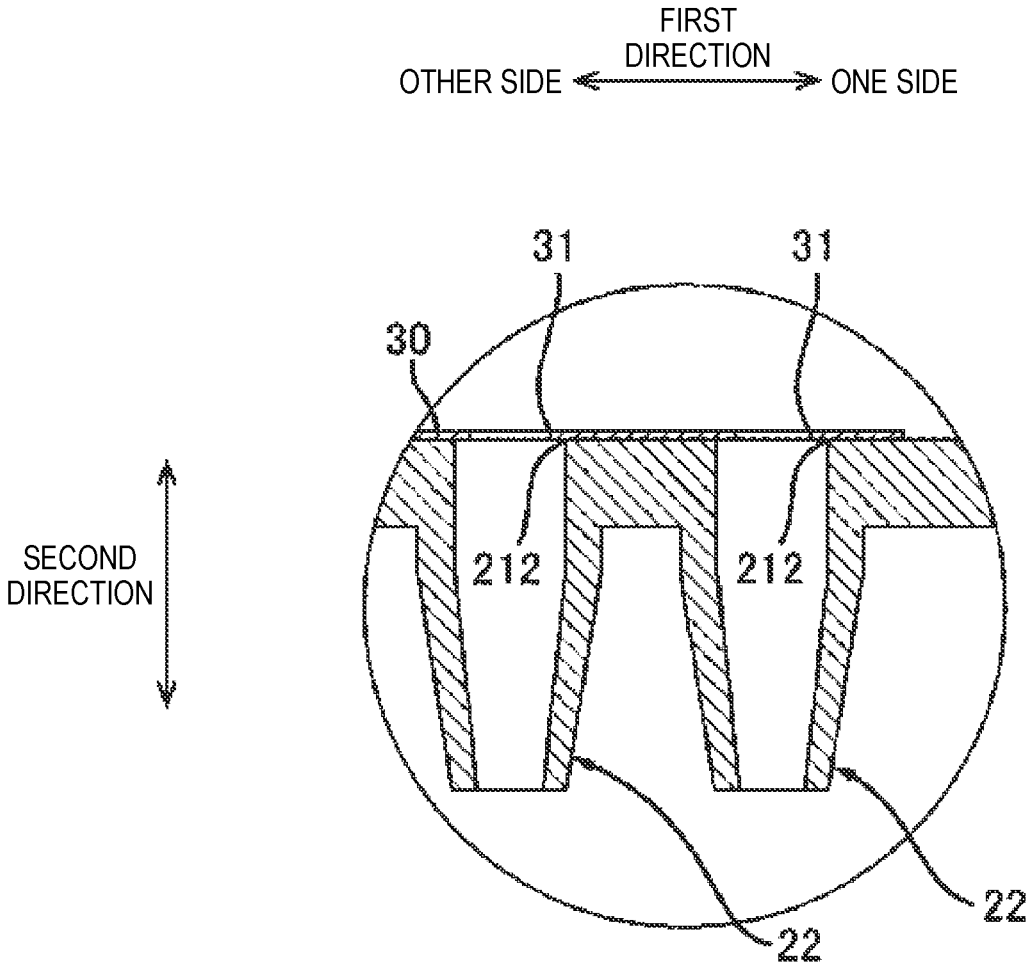
FIG. 6 illustrates a first modified example.
Figure 7:
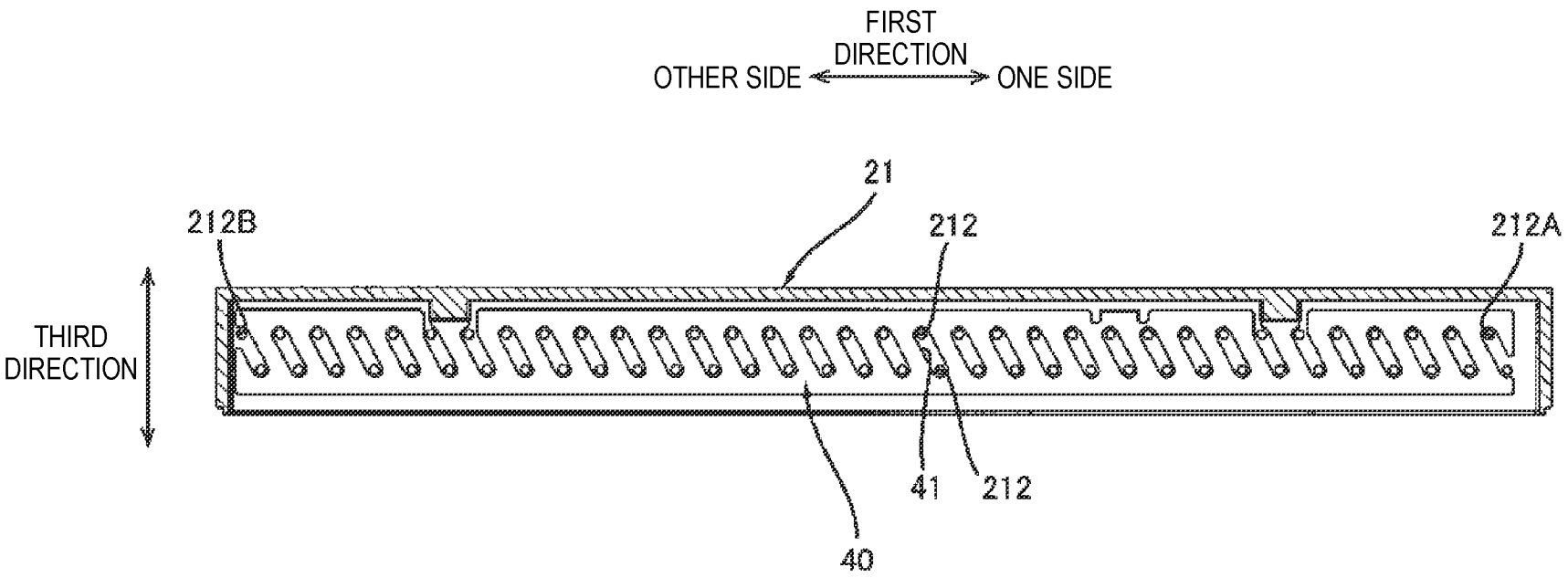
FIG. 7 illustrates a second modified example.
Figure 8:
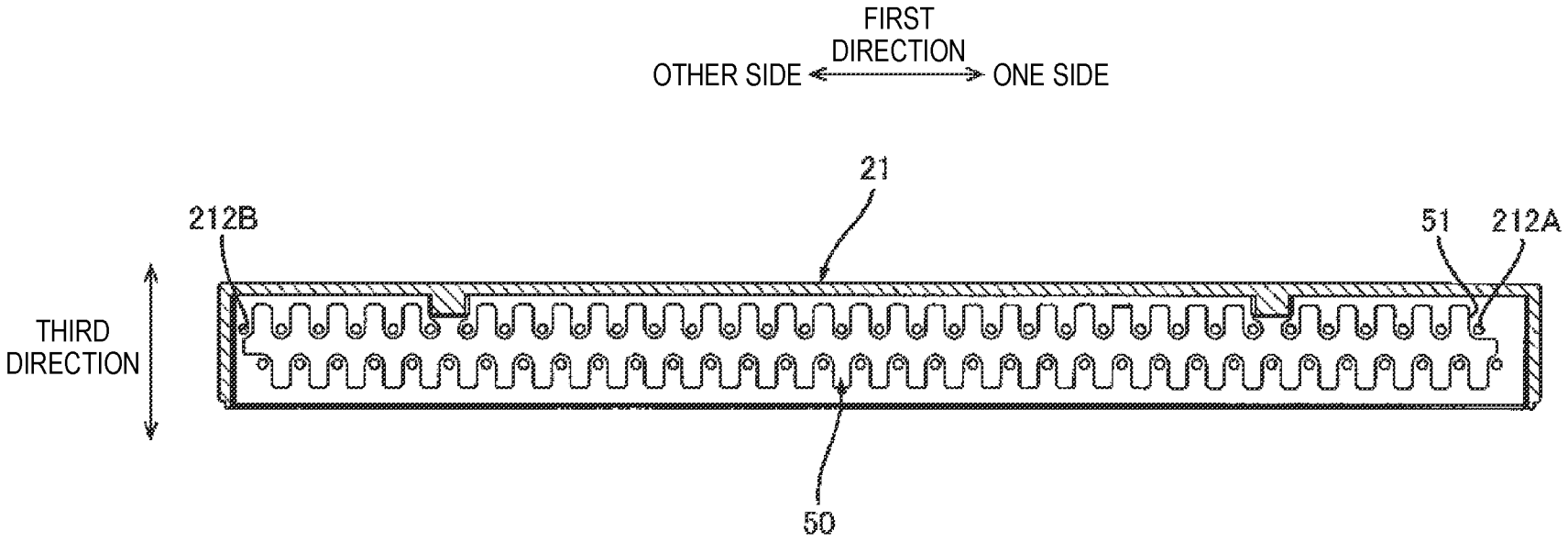
FIG. 8 illustrates a third modified example.

For example, as shown in FIG. 6, a diameter of a notch 31 of a nozzle electrode 30 may be smaller than the diameter of the hole 212 of the housing 21. Specifically, a diameter of a first notch 31A may be smaller than the diameter of the first hole 212A, and a diameter of a second notch 31B may also be smaller than the diameter of the second hole 212B. In addition, as shown in FIG. 7, notches 41 of a nozzle electrode 40 may be formed to communicate with the plurality of holes 212. In addition, as shown in FIG. 8, notches 51 of a nozzle electrode 50 may not have a circular shape.

Figure 9:
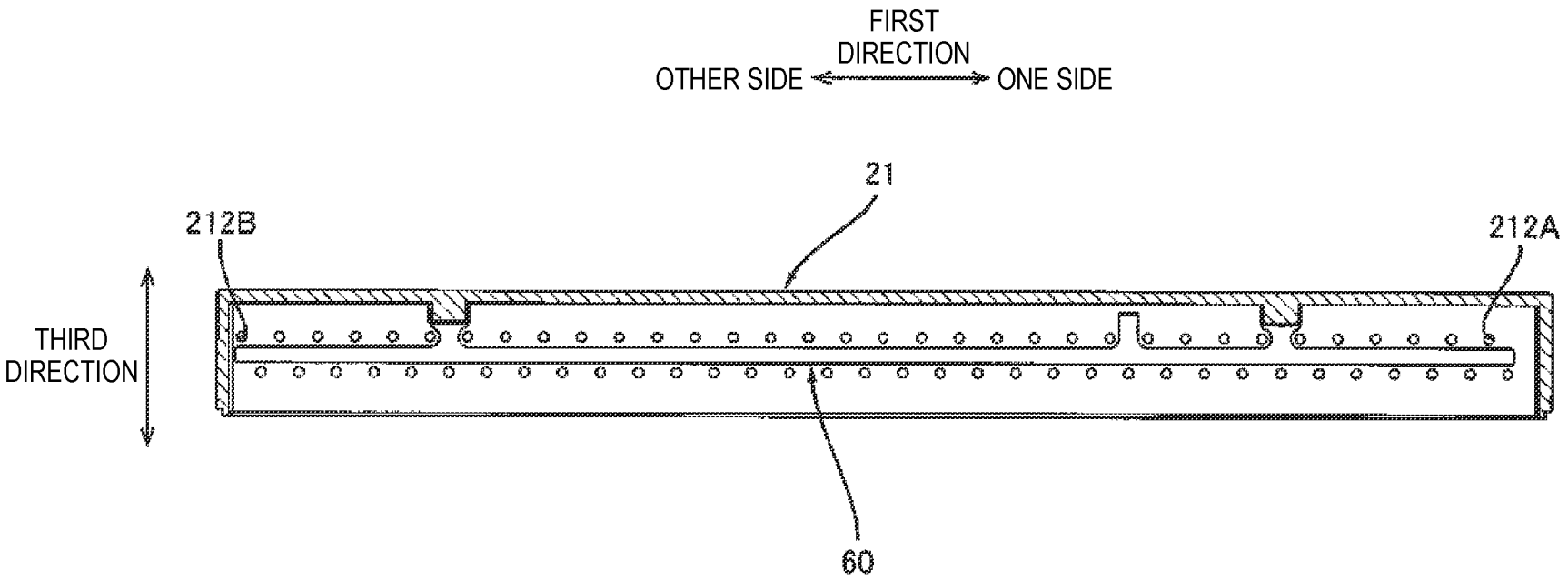
FIG. 9 illustrates a fourth modified example.

Further, the nozzle electrode 23 is not limited in terms of a shape as long as it extends from the first nozzle 22A to the second nozzle 22B in the first direction. For example, as shown in FIG. 9, a nozzle electrode 60 may have a circular column shape extending in the first direction.

Also in these modified examples, the operational effects similar to the above embodiment can be realized.

Figure 10A:
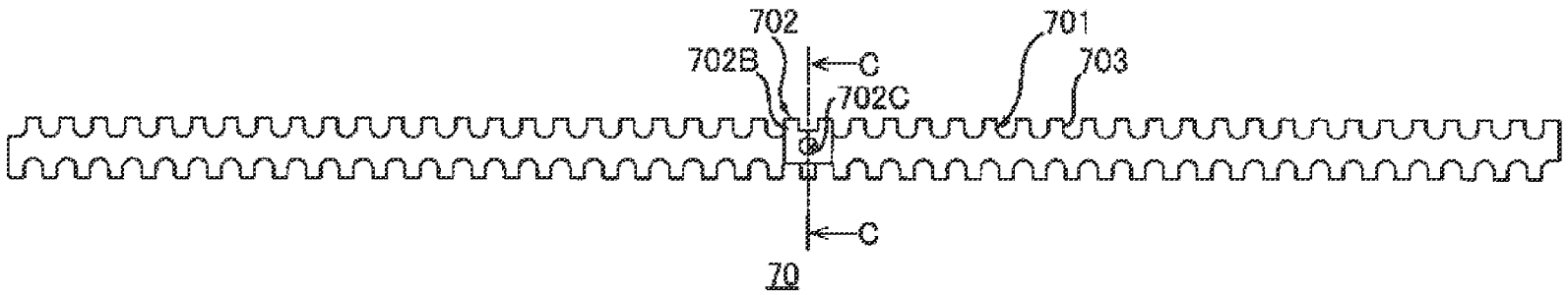
FIG. 10A illustrates a fifth modified example.

(2) As shown in FIG. 10A, a nozzle electrode 70 may have a body portion 701 and a contact portion 702 without the two fixing portions 233A and 233B. Specifically, the nozzle electrode 70 mat not be attached to the inner surface of the housing 21.

The body portion 701 extends in the first direction, similar to the body portion 231 (refer to FIG. 5A) of the above embodiment. The body portion 701 has a flat plate shape. The body portion 701 has a plurality of notches 703.

Figure 10B:
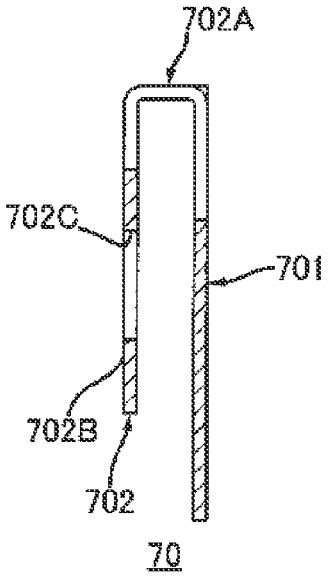
FIG. 10B is a cross-sectional view taken along a line C-C of FIG. 10A.

As shown in FIG. 10B, the contact portion 702 extends from the body portion 701, similar to the contact portion 232 (refer to FIG. 5B) of the above embodiment. The contact portion 702 has a bent plate shape. The contact portion 702 has a first portion 702A, a second portion 702B and a hole 702C. In other words, the nozzle electrode 70 has one hole 702C.

The first portion 702A extends from the body portion 701 in the second direction.

The second portion 702B extends from the first portion 702A in the third direction. The second portion 702B is located at an interval from the body portion 701 in the second direction.

The hole 702C is located at the second portion 702B. The hole 702C has a circular shape. The hole 702C is a through-hole.

Figure 11:
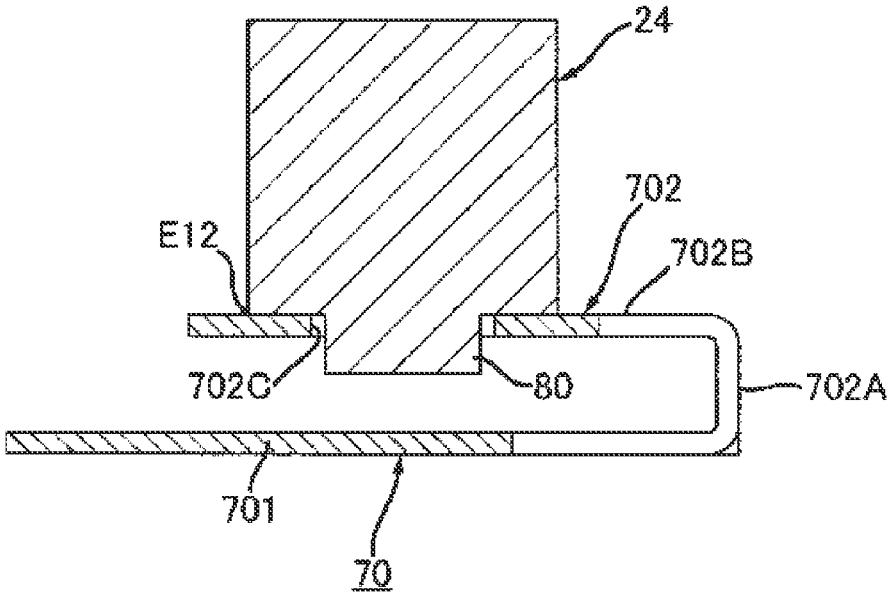
FIG. 11 illustrates connection of a contact portion and a supply electrode shown in FIG. 10B.

As shown in FIG. 11, the supply electrode 24 has one projection 80.

The projection 80 is located at the second end portion E12 of the supply electrode 23. The projection 80 extends from the second end portion E12 of the supply electrode 23 in the second direction. The projection 80 has a circular column shape. The projection 80 is fitted in the hole 702C.

Also in the modified example, the operational effects similar to the above embodiment can be realized.

Further, according to this modified example, with the simple configuration where the nozzle electrode 70 does not have the two fixing portions 233A and 233B and the projection 80 is fitted in the hole 702C, it is possible to easily decide a position of the nozzle electrode 70 with respect to the housing 21 via the supply electrode 24.

For this reason, as compared to the configuration where the nozzle electrode 70 is attached to the housing 21 with the two fixing portions 233A and 233B, the nozzle unit 9A can be made smaller.

Note that, when the nozzle electrode 70 rotates with respect to the projection 80, the nozzle electrode 70 is contacted to the inner surface of the housing 21 and is thus stopped.

In addition, the projection 80 is fitted in the hole 702C, so that it is possible to decide the position of the nozzle electrode 70 with respect to the supply electrode 24 at one place.

For this reason, it is possible to suppress a force, which is caused due to a difference in linear expansion between the nozzle electrode 70 and the housing 21, from being applied to the nozzle electrode 70.

(3) In the modified example (2), the supply electrode 24 may have a hole, and the nozzle electrode 70 may have a projection that is fitted in the hole of the supply electrode 24.

The shapes of the projection 80 and the hole 702C are not limited. For example, the hole 702 C may have a quadrangular shape, and the projection 80 may have a prismatic shape.

(4) The plurality of modified examples may be combined with each other.

What is claimed is:

1. A fixing device comprising a nozzle unit that sprays a fixing solution to a sheet on which a toner image is formed, and provided to fix the toner image on the sheet, wherein the nozzle unit comprises:

a housing capable of accommodating the fixing solution;

a nozzle electrode located inside the housing and extending in a first direction, the first direction intersecting with a direction in which the sheet is conveyed and being a width direction of the sheet; and a plurality of nozzles provided to discharge the fixing solution electrically charged by the nozzle electrode from the housing, aligned along the first direction, and comprising a first nozzle and a second nozzle located at an interval from the first nozzle in the first direction, and a length of the nozzle electrode in the first direction is greater than the interval between the first nozzle and the second nozzle in the first direction.

2. The fixing device according to claim 1, further comprising an opposite electrode located at an interval from the nozzle unit in a second direction intersecting with the first direction, a voltage being applied to the opposite electrode.

3. The fixing device according to claim 2, wherein the first direction intersects with a third direction in which the sheet is conveyed, and the second direction intersects with the third direction.

4. The fixing device according to claim 3, wherein the first nozzle is located at one end of the plurality of nozzles in the first direction, and the second nozzle is located at the other end of the plurality of nozzles in the first direction.

5. The fixing device according to claim 3, wherein the housing has an inlet through which the fixing solution entering the housing passes, and the nozzle electrode is located between the plurality of nozzles and the inlet in the second direction.

6. The fixing device according to claim 5, wherein the nozzle electrode is located closer to the plurality of nozzles than the inlet in the second direction.

7. The fixing device according to claim 2, wherein the first nozzle is located at one end of the plurality of nozzles in the first direction, and the second nozzle is located at the other end of the plurality of nozzles in the first direction.

8. The fixing device according to claim 2, wherein the housing has an inlet through which the fixing solution entering the housing passes, and the nozzle electrode is located between the plurality of nozzles and the inlet in the second direction.

9. The fixing device according to claim 8, wherein the nozzle electrode is located closer to the plurality of nozzles than the inlet in the second direction.

10. The fixing device according to claim 1, wherein the first nozzle is located at one end of the plurality of nozzles in the first direction, and the second nozzle is located at the other end of the plurality of nozzles in the first direction.

11. The fixing device according to claim 1, wherein the plurality of nozzles are located on an outer surface of the housing, and the nozzle electrode is located on an inner surface of the housing.

12. The fixing device according to claim 11, wherein the nozzle electrode is in contact with the inner surface of the housing.

13. The fixing device according to claim 12, wherein the nozzle electrode is attached to the inner surface of the housing by heat caulking.

14. The fixing device according to claim 1, wherein the housing has a first hole allowing the fixing solution to enter the first nozzle and a second hole allowing the fixing solution to enter the second nozzle, and the nozzle electrode has a first notch allowing the fixing solution to enter the first hole and a second notch allowing the fixing solution to enter the second hole.

15. The fixing device according to claim 14, wherein a diameter of the first notch is smaller than a diameter of the first hole, and a diameter of the second notch is smaller than a diameter of the second hole.

16. The fixing device according to claim 1, wherein the nozzle unit further comprises a supply electrode provided to supply electric power to the nozzle electrode, supported by the housing, and electrically connected to the nozzle electrode.

17. The fixing device according to claim 16, wherein the supply electrode has a projection, and the nozzle electrode has a hole in which the projection is fitted.

18. The fixing device according to claim 1, wherein the nozzle electrode is made of metal.

* * * * *